US008944138B2

(12) United States Patent
Feldstein et al.

(10) Patent No.: US 8,944,138 B2
(45) Date of Patent: Feb. 3, 2015

(54) SYSTEM FOR COUPLING A ROLLER SHADE AND SHADE MOTOR

(71) Applicants: George Feldstein, Cresskill, NJ (US); Timothy Wickham, Tappan, NY (US)

(72) Inventors: George Feldstein, Cresskill, NJ (US); Timothy Wickham, Tappan, NY (US)

(73) Assignee: Creston Electronics Inc., Rockleigh, NJ (US)

( * ) Notice: Subject to any disclaimer, the term of this patent is extended or adjusted under 35 U.S.C. 154(b) by 0 days.

(21) Appl. No.: 13/677,915

(22) Filed: Nov. 15, 2012

(65) Prior Publication Data

US 2013/0126107 A1 May 23, 2013

Related U.S. Application Data

(60) Provisional application No. 61/561,386, filed on Nov. 18, 2011.

(51) Int. Cl.
*A47G 5/02* (2006.01)

(52) U.S. Cl.
USPC ..... 160/310

(58) Field of Classification Search
USPC ..... 160/323.1, 310
IPC ..... E06B 9/72
See application file for complete search history.

(56) References Cited

U.S. PATENT DOCUMENTS

| | | | | | |
|---|---|---|---|---|---|
| 4,172,563 | A * | 10/1979 | Werner et al. | ..... | 242/390.1 |
| 5,803,150 | A * | 9/1998 | Boiteau | ..... | 160/310 |
| 2003/0000657 | A1 * | 1/2003 | Dupielet et al. | ..... | 160/310 |
| 2011/0265958 | A1 * | 11/2011 | Skinner et al. | ..... | 160/127 |

FOREIGN PATENT DOCUMENTS

GB 1515033 * 6/1978

* cited by examiner

*Primary Examiner* — Blair M. Johnson
(74) *Attorney, Agent, or Firm* — Creston Electronics Inc.

(57) ABSTRACT

Presented is a roller shade system that includes a roller shade drive unit that includes a shade motor and a motor crown that includes one or more grooves. The system further includes a roller shade tube, and a motor crown adapter. The motor crown adapter includes a flange and a cylindrical portion that includes one or more tabs. The cylindrical portion is disposed inside, and coupled to, the roller shade tube. The flange and cylindrical portion together define an opening for receiving the shade motor therethrough. The one or more tabs are configured for engaging the one or more grooves to releaseably couple the motor crown adapter to the motor crown.

6 Claims, 5 Drawing Sheets

SYSTEM FOR COUPLING A ROLLER SHADE AND SHADE MOTOR

BACKGROUND OF THE INVENTION

1. Technical Field

The present disclosure relates generally to roller shades and roller shade motors, and more particularly to a system for removeably coupling a roller shade motor to a roller shade tube.

2. Background

Typically, a roller shade motor is either attached to a roller shade tube using screws/rivets (i.e., retaining hardware) or simply slid into the roller shade tube without any securing means. If the roller shade motor is attached to the roller shade tube, the roller shade motor can only be detached from the roller shade tube after the roller shade fabric is completely unwound from the roller shade tube so that the retaining hardware can be accessed. If the roller shade motor is not secured to the roller shade tube, the motor could easily slide out from inside the roller shade tube during shade installation and impact the floor, which could cause damage to both the roller shade motor and the floor.

SUMMARY OF THE INVENTION

In one aspect, the disclosure involves a roller shade system. The roller shade system includes a roller shade drive unit that includes a shade motor and a motor crown that includes one or more grooves. The system further includes a roller shade tube, and a motor crown adapter. The motor crown adapter includes a flange and a cylindrical portion that includes one or more tabs. The cylindrical portion is disposed inside, and coupled to, the roller shade tube. The flange and cylindrical portion together define an opening for receiving the shade motor therethrough. The one or more tabs are configured for engaging the one or more grooves to releaseably couple the motor crown adapter to the motor crown.

In another aspect, the disclosure involves a shade motor crown adapter. The motor crown adapter includes a flange, and a cylindrical portion comprising one or more tabs. The cylindrical portion is configured and dimensioned to be disposed inside, and coupled to, a roller shade tube. The flange and cylindrical portion together define an opening for receiving a shade motor therethrough. The one or more tabs are configured for engaging a shade motor crown to releaseably couple the motor crown adapter to the shade motor crown.

BRIEF DESCRIPTION OF THE DRAWINGS

The accompanying figures further illustrate the present disclosure. Exemplary embodiments are illustrated in reference figures of the drawings. It is intended that the embodiments and figures disclosed herein are to be considered to illustrative rather than limiting.

The components in the drawings are not necessarily drawn to scale, emphasis instead being placed upon clearly illustrating the principles of the present disclosure. In the drawings, like reference numerals designate corresponding parts throughout the several views.

LIST OF REFERENCE NUMBERS FOR THE MAJOR ELEMENTS IN THE DRAWING

Figure 1A:
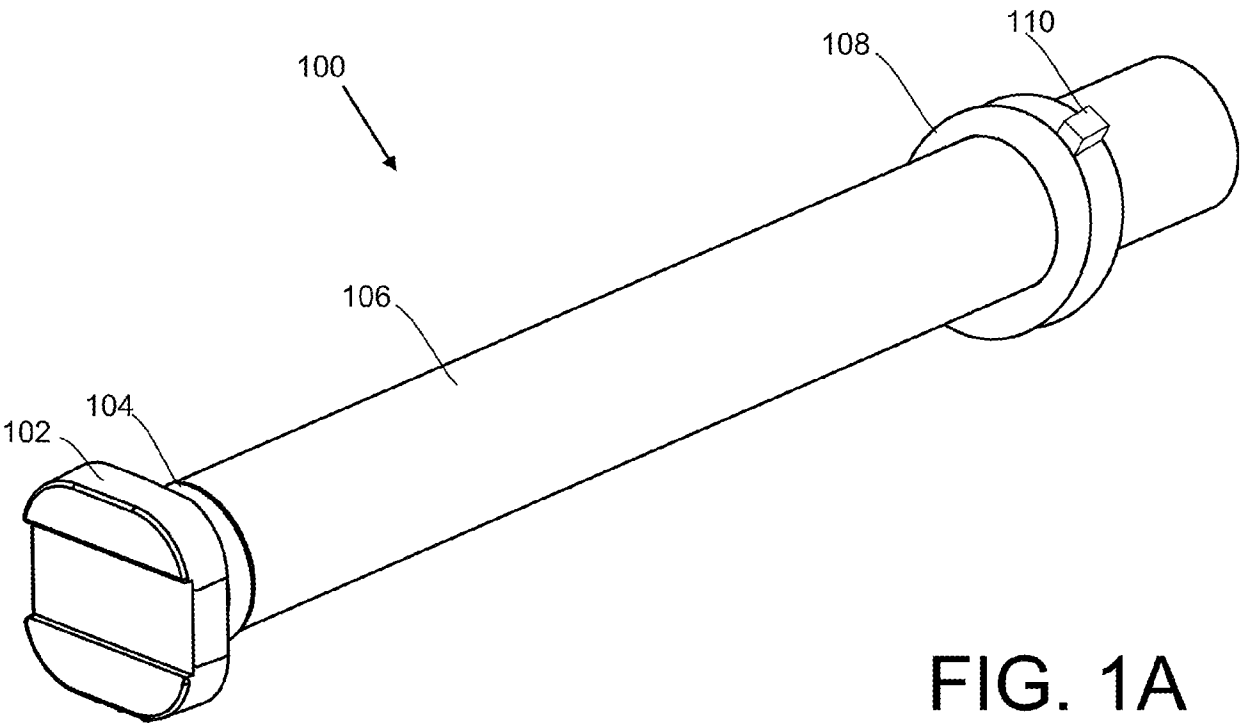
FIG. 1A is an illustrative Isometric projection of a roller shade drive unit, according to one embodiment of the invention.

The following is a list of the major elements in the drawings in numerical order.

100 roller shade drive unit
102 control unit
104 motor crown
106 motor
108 drive wheel
110 raised member
112 roller shade tube
114 roller shade fabric
116 inner surface
118 edge surface
119 threaded screw hole
120 raised member
122 motor crown adapter
124 tab
126 flange bottom surface
128 cylindrical portion
129 contact surface
130 flange
132 opening
134 screw hole
304 groove
306 O-ring
308 groove
310 screw

DETAILED DESCRIPTION OF THE INVENTION

Reference will now be made to the exemplary embodiments illustrated in the drawings, and specific language will be used herein to describe the same. It will nevertheless be understood that no limitation of the scope of the invention is thereby intended. Alterations and further modifications of the features illustrated herein, and additional applications of the principles of the disclosure as illustrated herein, which would occur to one skilled in the relevant art and having possession of this disclosure, are to be considered within the scope of the disclosure.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

MODE(S) FOR CARRYING OUT THE INVENTION

The present disclosure involves a system and method for removeably or releaseably coupling a roller shade motor to a roller shade tube without having to unroll roller shade fabric from the roller shade tube.

Referring to FIGS. 1A-C and FIG. 2, in one embodiment, various elements of a roller shade system are shown. The system includes a roller shade drive unit 100, a roller shade tube 112, and a motor crown adapter 122.

In one embodiment, as shown in FIG. 1A, the roller shade drive unit 100 includes a control unit 102, a motor crown 104, a motor 106, and a drive wheel 108. The drive wheel 108 includes one or more raised members 110.

Figure 1B:
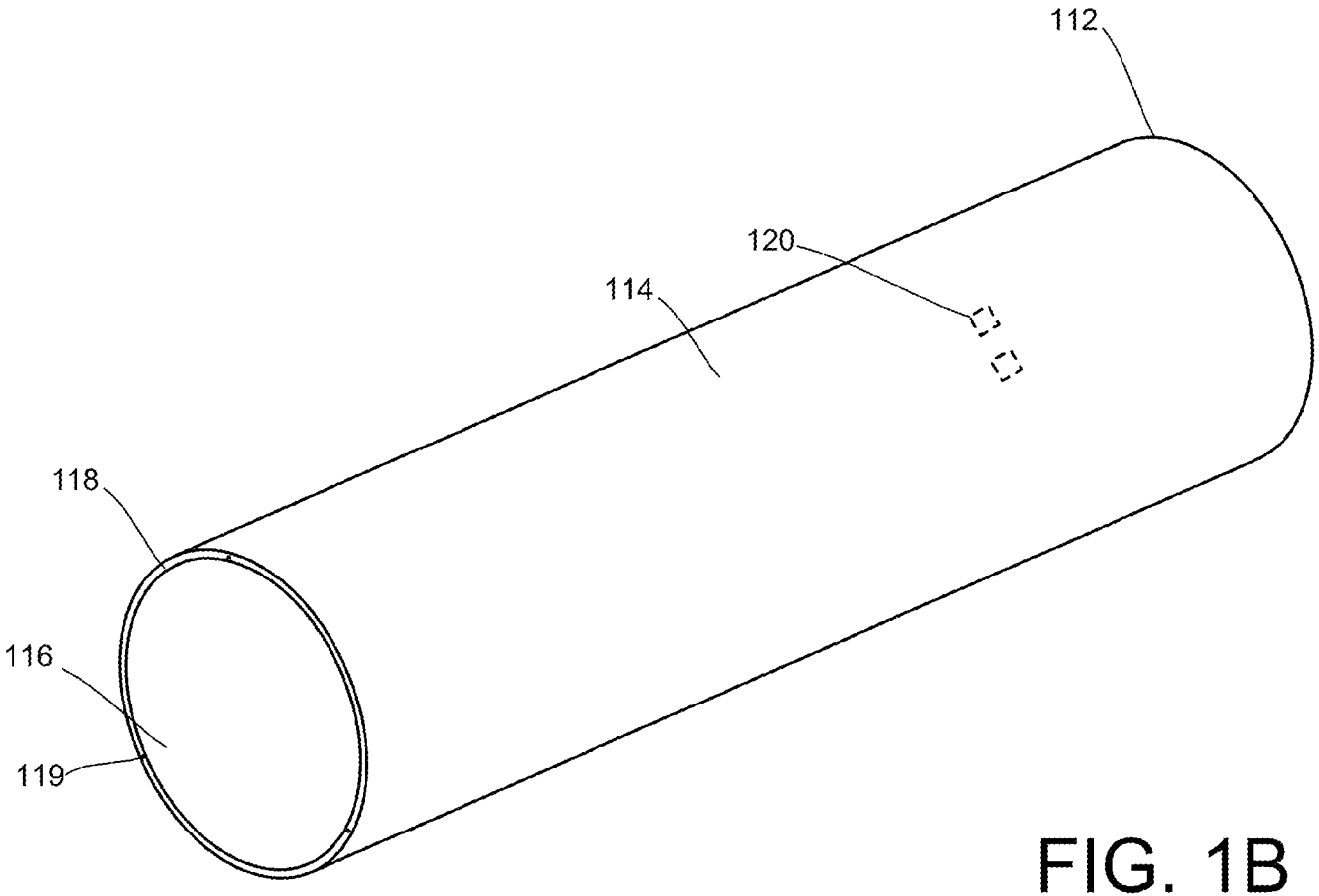
FIG. 1B is an illustrative Isometric projection of a roller shade tube, according to one embodiment of the invention.

In one embodiment, as shown in FIG. 1B, the roller shade tube 112 includes roller shade fabric 114, which is wound around the roller shade tube 112. The roller shade tube 112 further includes an inner surface 116 and an edge surface 118. The edge surface includes a plurality of threaded screw holes 119. One or more raised members 120 are disposed on the inner surface 116. In various embodiments, the roller shade tube 112 is made of plastic, metal, or fiberglass, or any other appropriate material known to those skilled in the art.

Figure 1C:
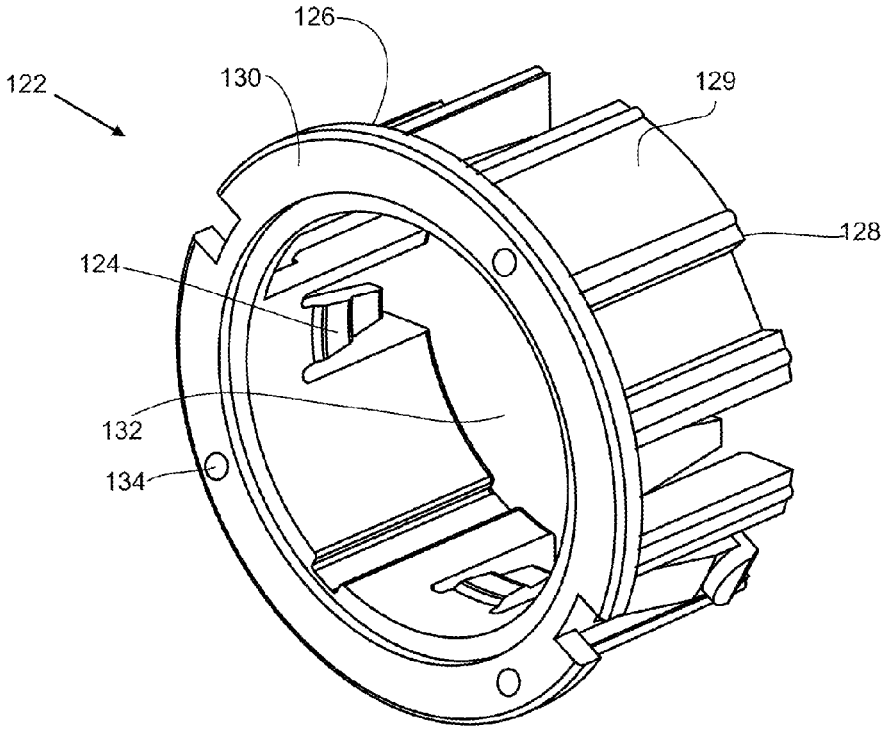
FIG. 1C is an illustrative Isometric projection of a motor crown adapter, according to one embodiment of the invention.
Figure 2:
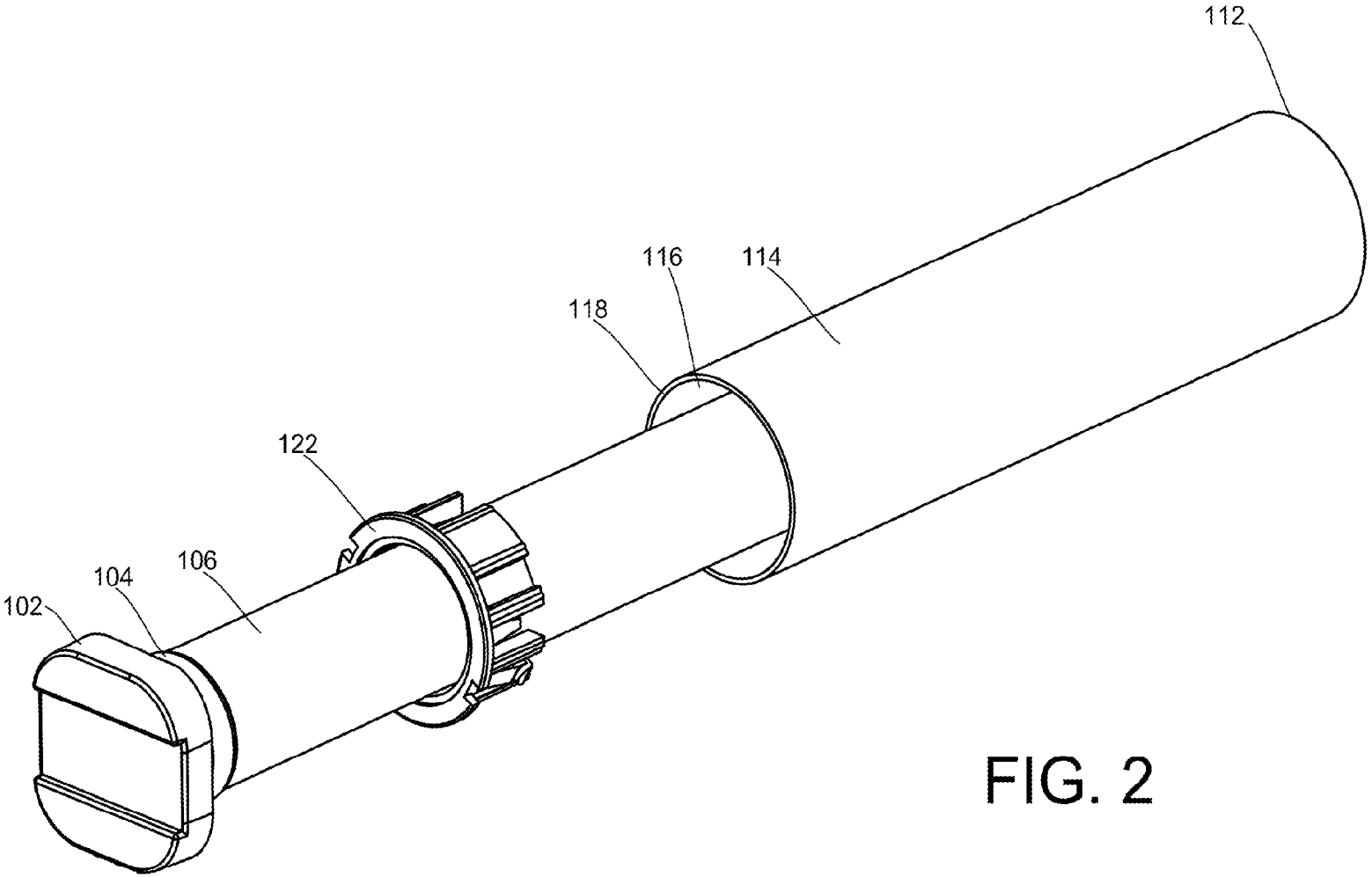
FIG. 2 is an illustrative Isometric projection of the roller shade drive unit, the crown adapter, and the roller shade tube of FIGS. 1A-1C.

In one embodiment, as shown in FIG. 1C, the motor crown adapter 122 includes a flange 130 with a bottom surface 126. The motor crown adapter 122 further includes a cylindrical portion 128, which includes one or more contact surfaces 129 and one or more tabs 124. The flange 130 includes a plurality of unthreaded screw holes 134. The flange 130 together with the cylindrical portion 128 defines an opening 132. In various embodiments, the motor crown adapter 122 is made of plastic, metal, or fiberglass or any other appropriate material known to those skilled in the art.

Figure 3:
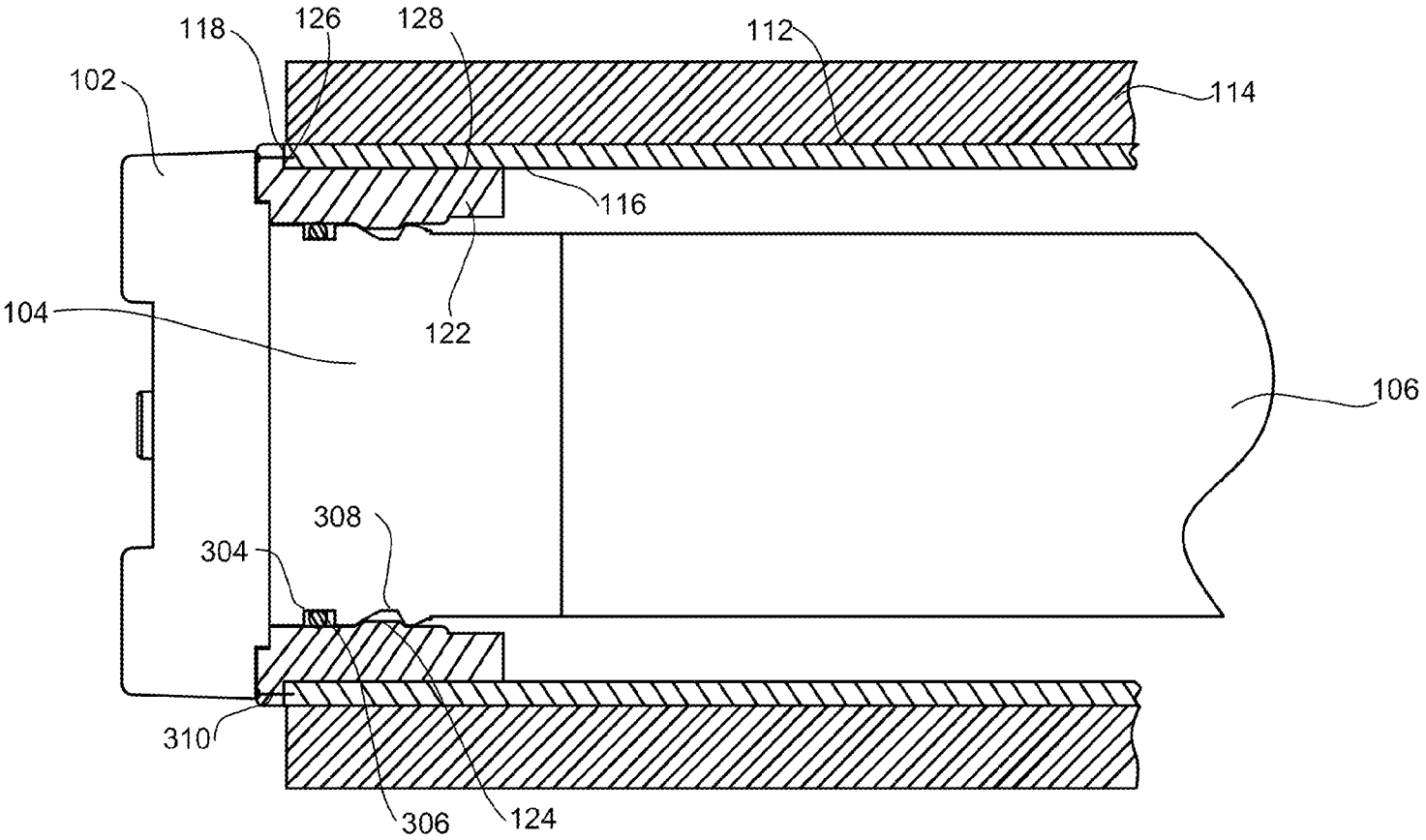
FIG. 3 is an illustrative side elevational view of a roller shade motor unit including a cross-sectional side view of a motor crown adapter and a roller shade tube, according to one embodiment of the invention.

Referring to FIG. 3, the cylindrical portion 128 of the motor crown adapter 122 is inserted into the roller shade tube 112 so that the one or more contact surfaces 128 contact the inner surface 116 of the roller shade tube 112 and the bottom surface 126 of the flange 130 contacts the edge surface 118 of the roller shade tube 112. In one embodiment, the flange 130 includes a plurality of unthreaded screw holes 134. The motor crown adapter 122 is coupled to the roller shade tube 112 by inserting screws 310 through the unthreaded screw holes 134 and into the threaded screw holes 119.

In other embodiments, the crown adapter 122 is coupled to the roller shade tube 112 by gluing the bottom surface 126 of the flange 130 to the edge surface 118 of the roller shade tube 112, gluing the one or more contact surfaces 128 to the inner surface 116 of the roller shade tube 112, or though other methods known to those skilled in the art.

In one embodiment, after the crown adapter 122 is coupled to the roller shade tube 112, the end of the motor 106 that includes the drive wheel 108 is inserted though the opening 132 of the crown adapter 122. The motor 106 is pushed into the roller shade tube 112 until the raised member 110 on the drive wheel 108 engages the raised members 120 (on the inner surface 116 of the roller shade tube 112) and the crown adapter 122 engages and removeably/releaseably couples to the motor crown 104.

In another embodiment, before the crown adapter 122 is coupled to the roller shade tube 112, the drive wheel 108 is detached from the motor 106 and the motor 106 is inserted through the opening 132. Thereafter, the drive wheel 108 is reattached to the motor 106, the motor 106 is inserted into the roller shade tube 112, and the crown adapter 122 is then coupled to the roller shade tube as described above.

Still referring to FIG. 3, the motor crown 104 includes a groove 304 and a groove 308. The motor crown 104 further includes an O-ring 306 wrapped therearound. The O-ring 306 is disposed in, and held in place by, the groove 304. The crown adapter 122 removeably/releaseably couples to the motor crown 104 when the motor 106 is pushed far enough into the roller shade tube 112 so the one or more tabs 124 of the motor crown 122 slide into the groove 308 of the motor crown 104. Thereafter, the roller shade tube 112 is held coupled to the drive unit 100 until manually separated (i.e., pulled apart).

The above-described roller shade system allows the roller shade tube to be coupled to or removed from the roller shade drive unit without having to unwind the roller shade fabric. Further, the roller shade system prevents the roller shade drive unit form accidentally slipping out to the roller shade tube during installation or maintenance.

ALTERNATE EMBODIMENTS

Variations, modifications, and other implementations of what is described herein may occur to those of ordinary skill in the art without departing from the spirit and scope of the disclosure. Accordingly, the disclosure is not to be defined exclusively by the preceding illustrative description.

What is claimed is:

1. A roller shade system comprising:

a roller shade drive unit comprising a shade motor and a motor crown comprising one or more grooves;

a roller shade tube; and a motor crown adapter comprising a flange and a cylindrical portion comprising one or more tabs, the cylindrical portion being disposed inside and coupled to the roller shade tube, the flange and cylindrical portion together defining an opening for receiving the shade motor therethrough in one piece from one direction and for removing the shade motor therethrough in one piece from the opposite direction, and the one or more tabs being configured for engaging the one or more grooves to releaseably couple the motor crown adapter to the motor crown.

2. The system of claim 1, wherein the roller shade drive unit further comprises a drive wheel comprising one or more raised members, and the roller shade tube comprises an inner surface and one or more raised members disposed thereon, the one or more raised members of the drive wheel being configured for engaging the one or more raised members of the roller shade tube when the shade motor is disposed in the roller shade tube.

3. The system of claim 1, wherein the motor crown adapter comprises at least one of plastic, metal, or fiberglass.

4. The system of claim 1, wherein the flange comprises a plurality of screw holes configured for receiving mounting screws dimensioned and arranged for coupling the motor crown adapter to the roller shade tube.

5. The system of claim 1, wherein the motor crown adapter comprises a plurality of contact surfaces configured to contact an inner surface of the roller shade tube to couple the motor crown adapter to the roller shade tube via a friction fit.

6. The system of claim 1, further comprising an O-ring disposed between the motor crown and the motor crown adapter.

* * * * *